US005335512A

United States Patent [19]

Hancock et al.

[11] Patent Number: 5,335,512

[45] Date of Patent: Aug. 9, 1994

[54] REFRIGERANT RECOVERY DEVICE

[75] Inventors: John P. Hancock; Ralph A. McClelland, both of Indianapolis, Ind.

[73] Assignee: K-Whit Tools, Inc., Fishers, Ind.

[21] Appl. No.: 987,352

[22] Filed: Dec. 7, 1992

Related U.S. Application Data

[63] Continuation of Ser. No. 676,740, Mar. 28, 1991, Pat. No. 5,168,721.

[51] Int. Cl.[5] ..... F25B 45/00

[52] U.S. Cl. ..... 62/292; 62/77

[58] Field of Search ..... 62/292, 475, 77, 85, 62/125, 83, 84, 231

[56] References Cited

U.S. PATENT DOCUMENTS

| | | | |
|---|---|---|---|
| Re. 32,451 | 7/1987 | Proctor | 62/149 |
| Re. 33,212 | 5/1990 | Lower | 62/126 |
| 1,938,205 | 12/1933 | Yeomans | 62/292 |
| 2,044,096 | 6/1936 | Moran | 210/150 |
| 2,321,964 | 6/1943 | Zieber | 62/115 |
| 2,341,429 | 2/1944 | Elsey | 62/170 |
| 2,341,430 | 2/1944 | Elsey | 62/170 |
| 2,511,967 | 6/1950 | Campbell | 210/312.1 |
| 2,577,598 | 12/1951 | Zwickle | 62/117 |
| 2,590,061 | 3/1952 | Ash | 62/7 |
| 2,865,442 | 12/1958 | Halford | 158/36.3 |
| 2,917,110 | 12/1959 | Brohl | 158/36 |
| 2,972,235 | 2/1961 | Smith | 62/84 |
| 2,986,894 | 6/1961 | Endress | 62/85 |
| 3,070,977 | 1/1963 | Kimmel et al. | 62/473 |
| 3,131,548 | 5/1964 | Chubb et al. | 62/156 |
| 3,177,680 | 4/1965 | Rasovich et al. | 62/471 |
| 3,232,070 | 2/1966 | Sparano | 62/149 |
| 3,357,197 | 12/1967 | Massengale | 62/77 |
| 3,478,529 | 11/1969 | Boykin | 62/85 |
| 3,729,949 | 5/1973 | Talbot | 62/149 |
| 3,811,291 | 5/1974 | Schibbye | 62/84 |
| 3,872,687 | 3/1975 | Bottrum et al. | 62/243 |
| 3,874,192 | 4/1975 | Kato | 62/473 |

(List continued on next page.)

FOREIGN PATENT DOCUMENTS

| | | |
|---|---|---|
| 0071062 | 2/1983 | European Pat. Off. . |
| 0313079 | 4/1989 | European Pat. Off. . |
| 2056646A | 3/1991 | United Kingdom . |

OTHER PUBLICATIONS

Ser. No. 07/579,779 Filed Sep. 1990, Hancock & McClelland.

*Primary Examiner*—Albert J. Makay
*Assistant Examiner*—William C. Doerrler
*Attorney, Agent, or Firm*—Bose McKinney & Evans

[57] ABSTRACT

A single pass refrigerant recovery device recovers refrigerant from a refrigeration system. The device includes at least one hose for withdrawing refrigerant from the refrigeration system and a first oil separator disposed downstream of the refrigerant hose. A filter is disposed downstream from the oil separator and a compressor is disposed downstream from the filter. A second oil separator is disposed downstream from the compressor, and the condenser is disposed downstream from the second oil separator. A moisture indicator is disposed downstream from the condenser, and a storage tank is disposed downstream from the moisture indicator. The refrigerant recovery device also contains an oil return line having a first end disposed downstream from the second oil separator, and a second end disposed upstream from the compressor. A solenoid valve in the oil return line controls the flow of material in the oil return line. A timer for controls the opening and closing of the valve means for permitting the controlled flow of materials in the oil return line between the oil separator and the compressor during operation of the device to ensure an adequate replenishment of a supply of oil in the compressor, and for biasing the valve in an open position when the device is not operating to permit refrigerant to flow therethrough to substantially balance the pressure upstream from the compressor with the pressure downstream from the compressor.

16 Claims, 4 Drawing Sheets

U.S. PATENT DOCUMENTS

| | | | |
|---|---|---|---|
| 3,915,857 | 10/1975 | Olson | 210/62 |
| 3,978,685 | 9/1976 | Taylor | 62/471 |
| 4,110,998 | 9/1978 | Owen | 62/125 |
| 4,180,986 | 1/1980 | Shaw | 62/192 |
| 4,236,381 | 12/1980 | Imral et al. | 62/324.1 |
| 4,261,178 | 4/1981 | Cain | 62/149 |
| 4,285,206 | 8/1981 | Koser | 62/126 |
| 4,304,102 | 12/1981 | Gray | 62/195 |
| 4,363,222 | 12/1982 | Cain | 62/292 |
| 4,364,236 | 12/1982 | Lower | 62/77 |
| 4,441,330 | 4/1984 | Lower | 62/149 |
| 4,456,149 | 6/1984 | Sciortino | 222/1 |
| 4,470,265 | 9/1984 | Correla | 62/77 |
| 4,476,688 | 10/1984 | Goddard | 62/149 |
| 4,480,446 | 11/1984 | Margulefsky | 62/474 |
| 4,513,578 | 4/1985 | Proctor | 62/149 |
| 4,523,897 | 6/1985 | Lower | 417/244 |
| 4,537,038 | 8/1985 | Alsenz et al. | 62/118 |
| 4,539,817 | 9/1985 | Staggs | 62/149 |
| 4,554,792 | 11/1985 | Marguiefsky | 62/77 |
| 4,614,231 | 9/1986 | Proctor | 165/153 |
| 4,624,112 | 11/1986 | Proctor | 62/149 |
| 4,646,527 | 3/1987 | Taylor | 62/85 |
| 4,688,388 | 8/1987 | Lower | 62/126 |
| 4,768,347 | 9/1988 | Manz | 62/149 |
| 4,776,733 | 8/1988 | Scuderi | 62/77 |
| 4,798,055 | 1/1989 | Murray | 62/127 |
| 4,805,416 | 2/1989 | Manz | 62/292 |
| 4,809,520 | 3/1989 | Manz | 62/292 |
| 4,862,699 | 9/1989 | Lounis | 62/84 |
| 4,878,356 | 11/1989 | Punches | 62/149 |
| 4,903,499 | 2/1990 | Merritt | 62/149 |
| 4,909,042 | 3/1990 | Proctor | 62/149 |
| 4,916,915 | 4/1990 | Flinchbaugh | 62/129 |
| 4,934,390 | 6/1990 | Sapp | 134/22.18 |
| 4,938,031 | 7/1990 | Manz | 62/145 |
| 4,939,905 | 7/1990 | Manz | 62/77 |
| 4,942,741 | 7/1990 | Hancock et al. | 62/292 |
| 5,005,375 | 4/1991 | Manz et al. | 62/292 |
| 5,036,675 | 8/1991 | Anderson | 62/85 |
| 5,042,271 | 8/1991 | Manz | 62/473 |
| 5,161,385 | 11/1992 | Schumacher | 62/127 |

REFRIGERANT RECOVERY DEVICE

This is a continuation of copending application Ser. No. 07/676,740 filed on Mar. 28, 1991, now U.S. Pat. No. 5,168,721.

FIELD OF THE INVENTION

The present invention relates to a device for use in connection with a mechanical refrigeration system, and more particularly to a device for recovering refrigerant from a mechanical refrigeration system, processing the refrigerant so recovered to remove contaminants therefrom, and storing the processed refrigerant.

BACKGROUND OF THE INVENTION

A wide variety of mechanical refrigeration systems are currently in use in a wide variety of applications. Those familiar with mechanical refrigeration systems recognize that such systems require servicing periodically. This servicing often takes the form of the addition of refrigerant into the system to replace refrigerant which has escaped from the system. Before adding refrigerant, it is often necessary to evacuate the refrigerant remaining in the system. Typically, this remaining refrigerant is removed by bleeding the refrigerant off to the atmosphere.

In recent years, much concern has arisen about this practice of releasing fluorocarbon based refrigerants into the atmosphere. It is believed that the release of such fluorocarbons depletes the concentration of ozone in the atmosphere. This depletion of the ozone layer is believed to adversely impact the environment and human health.

To avoid releasing fluorocarbons into the atmosphere, devices have been constructed that are designed to recover the refrigerant from the refrigeration system. These refrigerant recovery devices often include means for processing the refrigerant so recovered so that the refrigerant can be reused.

Currently, several companies are involved in the manufacture and development of refrigerant recovery devices. These companies include K-Whit Tools, Inc., the assignee of the instant application, the ROBINAIR Manufacturing Corporation (later known as Kent-Moore Corporation), The Draf Tool Co., Inc., and the Murray Corporation.

Examples of products developed by K-Whit Tools, Inc., include the devices disclosed in U.S. Pat. No. 4,942,741 and U.S. patent application Ser. No. 07/579,779, both of which were invented by the inventors of the instant application, John P. Hancock and Ralph A. McClelland.

Examples of devices originating from ROBINAIR include those shown in Cain U.S. Pat. No. 4,261,178; Cain U.S. Pat. No. 4,363,222; Lower, et al. U.S. Pat. No. 4,441,330; Manz, et al. U.S. Pat. Nos. 4,768,347; 4,805,416; 4,809,520; and 4,938,031; and Punches et al U.S. Pat. No. 4,878,356.

An example of a device developed by Draf Tools Co., Inc. is shown in Koser U.S. Pat. No. 4,285,206. Koser discloses a device which both reclaims refrigerant, and is capable of providing fresh refrigerant for recharging the refrigeration system once evacuated. An example of a device developed by the Murray Corporation is shown in Proctor, et al. U.S. Pat. No. 4,909,042.

In addition to those devices developed by the organizations discussed above, several others have developed refrigerant recovery devices. Examples of these other devices are shown in Sparano U.S. Pat. No. 3,232,070; Massengale U.S. Pat. No. 3,357,197; Owen U.S. Pat. No. 4,110,998; Goddard U.S. Pat. No. 4,476,688; Margulefsky et al. U.S. Pat. Nos. 4,480,446 and 4,554,792; Staggs et al. U.S. Pat. No. 4,539,817; Taylor U.S. Pat. No. 4,646,527; and Lounis U.S. Pat. No. 4,862,699.

The patents discussed above are of interest in that they disclose a wide variety of devices for removing refrigerant from a refrigeration system, and processing the refrigeration so recovered. Some of the devices, such as the device shown in Manz et al U.S. Pat. No. 4,805,416 include a recycling loop wherein refrigerant that is withdrawn from a refrigeration system can be recycled through the purification loop of the recovery device to further purify the refrigerant. Other devices such as that shown in Cain U.S. Pat. No. 4,261,178 are primarily "single pass" devices wherein whatever processing is done to the refrigerant is done in a single pass of the refrigerant from the refrigeration system, through the device, and into the storage or disposal tank.

Although some, if not all of the devices discussed above are capable of removing and processing refrigerant, room for improvement exists. In particular, room for improvement exists in producing a more simple device which performs its intended function with less complexity than some prior known devices. Another area for improvement resides in providing a more simple oil separator and filter apparatus for use in a refrigerant recovery device.

It is therefore one object of the present invention to provide a refrigerant recovery device that provides a relatively simple, yet effective means for recovering refrigerant from a refrigeration system, and processing the refrigerant so recovered.

SUMMARY OF THE INVENTION

In accordance with the present invention, a single pass refrigerant recovery device is provided for recovering refrigerant from a refrigeration system. The device comprises at least one refrigerant hose for withdrawing refrigerant from the refrigeration system, and a first oil separator means disposed downstream from the refrigerant hose. A filter means is disposed downstream from the oil separator means. A compressor means is disposed downstream from the filter means and a second oil separator means is disposed downstream from the compressor means. A condenser means is disposed downstream from the second oil means, and a moisture indicator means is disposed downstream from the condenser means. A storage tank means is disposed downstream from the moisture indicator.

Also in accordance with the present invention, a combination oil separator and filter device is provided for a refrigerant recovery apparatus. The oil separator/filter device comprises a canister means having a first chamber portion for separating oil from the refrigerant and a second chamber portion for filtering the refrigerant. An inlet means is provided through which refrigerant can be introduced into the first chamber portion. An oil outlet means is provided for conducting oil from the first chamber portion. A filter cartridge is placeable in the second chamber portion and a refrigerant outlet means is provided through which refrigerant can be withdrawn from the second chamber portion.

Preferably, the canister includes a screen disposed in the path of refrigerant flow between the first chamber portion and the second chamber portion. A refrigerant hose connector is also provided for connecting a downstream end of a low side refrigerant hose and a downstream end of a high side refrigerant hose to the inlet means. An extended capillary tube means is provided that extends between the downstream end of the high side refrigerant hose and the inlet means to promote evaporation of refrigerant in the oil separator means.

One feature of the present invention is that the oil separator and filter are provided within a single canister structure having a first chamber portion for serving as an oil separator, and a second chamber portion for holding a filter cartridge. This feature has the advantage of providing a means for removing the predominant contaminants from the refrigerant that is efficient in operation, is elegant in design, is relatively inexpensive to manufacture, and is relatively compact when compared to some known devices.

Another feature of the present invention is that an extended capillary tube extends between the high side refrigerant hose and the inlet of the oil separator. This feature has the advantage of providing a more fine stream of liquid refrigerant flowing toward the oil separator. The use of this relatively more fine stream facilitates evaporation of the liquid refrigerant within the oil separator, and thus reduces the likelihood that refrigerant will pass through the oil separator and filter in a liquid phase.

Another feature of the present invention is that an oil return line is provided for returning oil from the second oil separator to the compressor wherein the flow of oil through the line is controlled by a solenoid valve and a timer arrangement. The solenoid valve is biased to be open when the device is in an off condition. This feature has advantages both when the device is operating and the device is shut off.

When the device is operating, the solenoid valve is normally closed. The valve is actuated to open in response to a timed cycle controlled by the timer. This controlled cycle provides a means for properly, controllably replenishing the supply of oil within the compressor.

When the device is not operating, the return tube allows refrigerant to flow to the upstream side of the compressor from the downstream side of the compressor. This flow of refrigerant to the upstream side of the compressor helps to balance the pressure on the upstream side of the compressor with the pressure on the downstream side of the compressor. The placement of the compressor in this balanced condition improves the start up characteristics of the compressor in succeeding operating cycles.

Additional features and advantages of the present invention will become apparent to those skilled in the art upon consideration of the following detailed description of a preferred embodiment exemplifying the best mode of carrying out the invention as perceived presently.

DETAILED DESCRIPTION OF PREFERRED EMBODIMENTS

Figure 1:
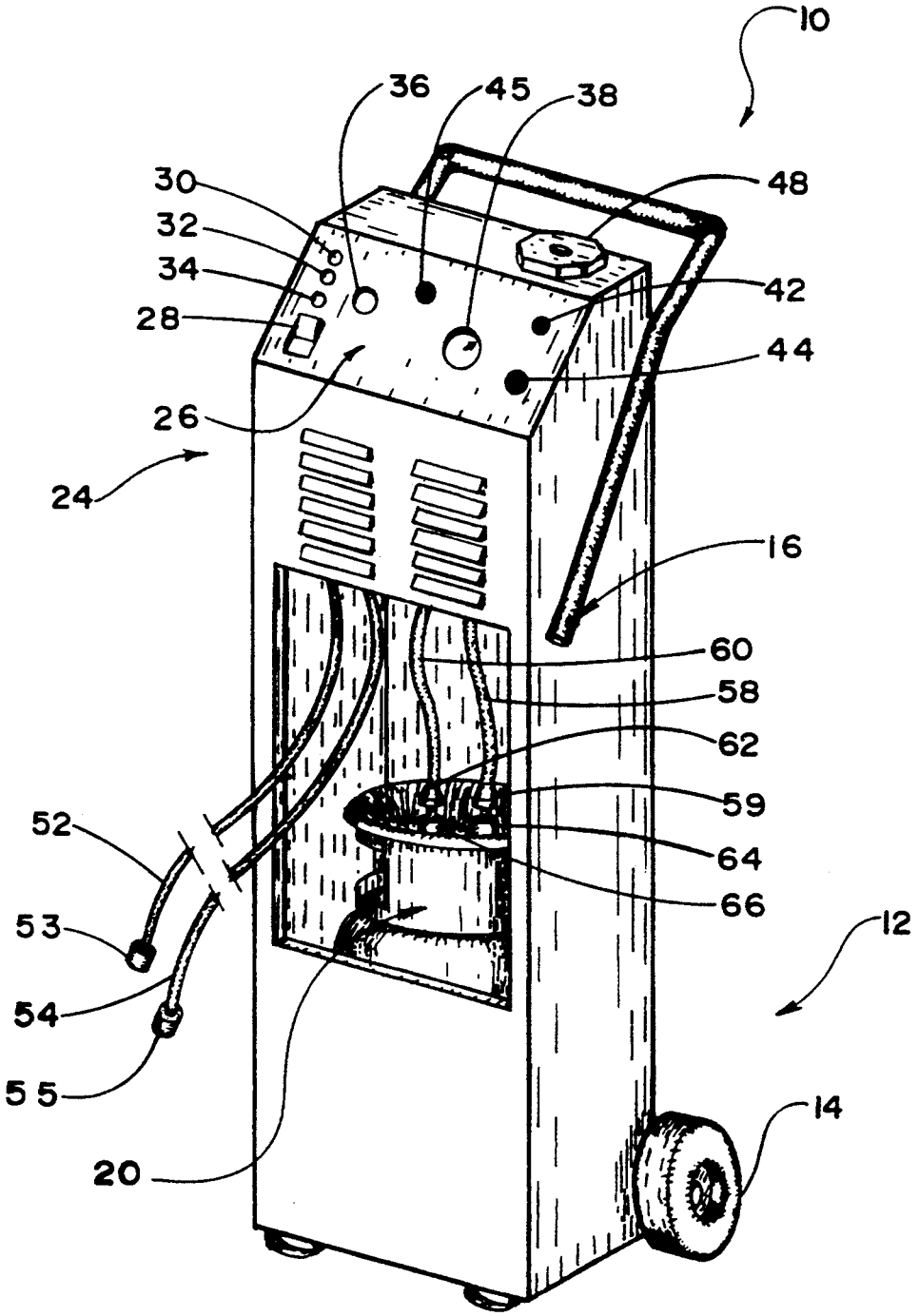
FIG. 1 is a perspective view of the refrigerant recovery device of the present invention.

A refrigerant recovery device 10 is shown in FIG. 1 as having a generally upright metal frame 12 supported on the ground by a pair of wheels 14. A handle 16 is coupled to the frame 12 to permit the device 10 to be wheeled into position for servicing a refrigeration system.

The device 10 includes a storage tank 20 which is generally similar in size, shape and construction to propane tanks used in connection with outdoor barbecue grills. The storage tank 20 is held within the lower portion of the device 10 and is intended for holding recovered refrigerant.

The operating components of the device are housed in the upper portion 24 of the device 10. A control panel 26 is disposed on the front surface of the upper portion 24. The control panel 26 includes a rocker type on/off switch 28 for energizing and de-energizing the control circuitry and components of the device 10. A system operating light 30 is also contained on the control panel 26. System operating light 30 is designed to be lighted when the on/off switch 28 is in its on position and the system is operating.

A tank full light 32 is provided for being lighted when the storage tank 20 is full, and a high pressure light 34 is provided for being lighted when an over-pressure condition exists within the device 10. As will be explained in more detail below, the lighting of the tank full light 32 and high pressure light 34 are usually accompanied by a cessation of operation of the compressor of the device 10.

A sight glass type moisture indicator 36 is also disposed on the control panel 26. A pressure gauge 38 is provided to enable the user to determine the pressure within the refrigeration system to be evacuated.

Three push button type controls are also disposed on the control panel 26. These push button controls include a momentary start button 42, a pressure test button 44, and an air purge valve button 45.

The momentary start button 42 is a depressible button that starts the operation of the components of the device 10 to begin its refrigerant recovery cycle. Momentary start button 42 is designed to be actuated and start the cycle of the device 10, only after the on/off switch 28 is placed in its on position.

The pressure test button 44 is directly coupled to, and actuates the opening of a valve to begin a pressure test function of the device 10. As will be explained in more detail below, the pressure test function permits some refrigerant contained within the device 10 to be directed back into the refrigeration system to be tested. Once the refrigerant enters into the refrigeration system to be tested, a refrigerant "sniffer" can be used to detect leaks within the refrigeration system.

The air purge valve button 45 is also directly coupled to a valve 98 that is normally closed. Depression of the air purge valve button 45 opens the valve 98 to allow collected air and separated oil to be purged from the device 10.

The lid 48 of the filter/oil separator 90 is disposed on the top surface of the refrigerant recovery device 10. The lid 48 is disposed externally of the device 10 to facilitate its removal during the replacement of a filter cartridge 104 within the filter/oil separator 90.

The device 10 also includes a plurality of hoses. The hoses enable the device 10 to be coupled in fluid communication to the refrigeration system to be serviced, and the storage tank 20. The hoses include a low side refrigerant hose 52 having a blocking valve connector member 53 disposed at its distal end. Blocking valve connector member 53 couples hose 52 to the low side refrigerant port of the refrigeration system to be serviced. A high side refrigerant hose 54 also includes a blocking valve connector member 55 at its end, which permits the high side refrigerant hose 54 to be coupled to the high pressure port of the refrigerant system to be serviced.

Blocking valve connector members 53, 55 are designed so that the flow of gas and liquid through the connecting members 53, 55 is normally blocked. However, the blocking valve connector members 53, 55 open to allow the passage of refrigerant therethrough when attached to the respective ports of the refrigeration system.

The third hose contained on the device 10 comprises a refrigerant delivery hose 58 which includes a blocking valve connector member 59 at its distal end. Blocking valve connector member 59 is coupled to a refrigerant inlet port 64 of the storage tank 20. The fourth hose of the device comprises an air purge hose 60 having a blocking valve connector member 62 at its distal end for connecting the air purge hose 60 to an air purge port 66 of the storage tank 20.

Figure 2:
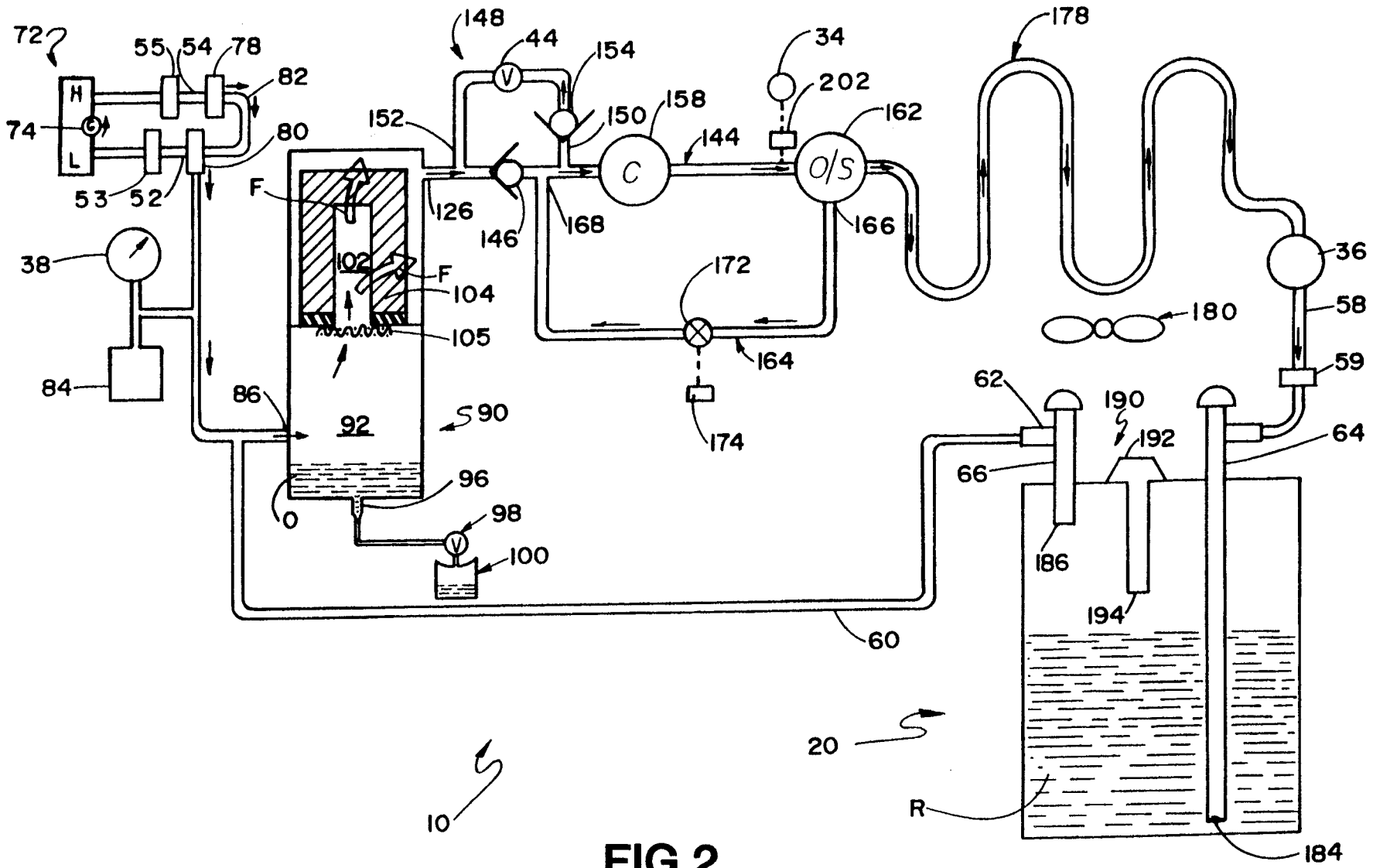
FIG. 2 is a schematic view of the components of the refrigerant recovery device.

The operating components and refrigerant flow path are best shown in FIG. 2.

The device 10 is shown in FIG. 2 as being coupled to a refrigeration system 72 to be serviced. Refrigeration system 72 can take the form of a refrigerator, air conditioner, heat pump, or other mechanical refrigeration system. Refrigeration system 72 includes a compressor 74, a high pressure port H disposed downstream from the compressor, and a low pressure port L disposed upstream the compressor. The high and low pressure ports H, L provide ports through which refrigerant can be added or removed from the refrigeration system 72.

The blocking valve connector member 55 of the high side refrigerant hose 54 is connected in fluid communication with the high pressure port H of the refrigeration system 72. The low side refrigerant hose 52 of the device 10 is coupled through blocking valve connector member 53 to the low pressure port L of the refrigeration system 72.

The high side refrigerant hose 54 is coupled at its proximal end to a first fitting member 78. The low side refrigerant hose 52 extends between the blocking valve connector member 53 at the distal end of the low side refrigerant hose 52, and a second fitting member 80. Second fitting member 80 is disposed adjacent to the proximal end of the low side refrigerant hose 52. A capillary tube means 82 extends between the first fitting 78 and second fitting 80. Capillary tube means 82 transfers refrigerant removed from the high pressure side H of the refrigeration system 72 to the second fitting 80, to cause the refrigerant recovered from the high pressure side H of the refrigeration system 72 to intermingle and mix with the refrigerant recovered from the low pressure side of the refrigeration system 72.

The capillary tube means 82 preferably comprises a long, reduced diameter tube preferably between about 5 feet and 7 feet (1.52 m and 2.13 m) in length. For example, in one preferred embodiment, the capillary tube 82 comprises a six foot (1.83 m) coil of 0.020 inch (0.51 mm) (inner diameter) copper tubing. The purpose of the capillary tube means 82 is to channel the refrigerant drawn from the high pressure side of the refrigeration system 72 into a fine stream within the capillary tube means 82 to better facilitate the evaporation of the stream of refrigerant once it enters the oil separator.

The device 10 also includes a pressure gauge a 38 and a vacuum switch 84 which are disposed upstream from the filter-dryer/oil separator 90. The vacuum switch 84 and the pressure gauge 38 are configured to be responsive to the pressure of the refrigeration system 72 to be serviced. The vacuum pressure switch 84 will cause the device 10 to cease operation upon sensing a vacuum in the refrigeration system 72. The sensing of such a vacuum indicates that all refrigerant has been recovered from the refrigeration system 72. An example of a commercially available pressure gauge is a gauge manufactured by AMETEK. Preferably vacuum pressure switch 84 is a 20PS034ECV04CV1OC model vacuum switch manufactured by TEXAS INSTRUMENTS of Dallas, Tex., and is designed to be actuated to open at pressures less than 5 mm Hg.

Figure 4:
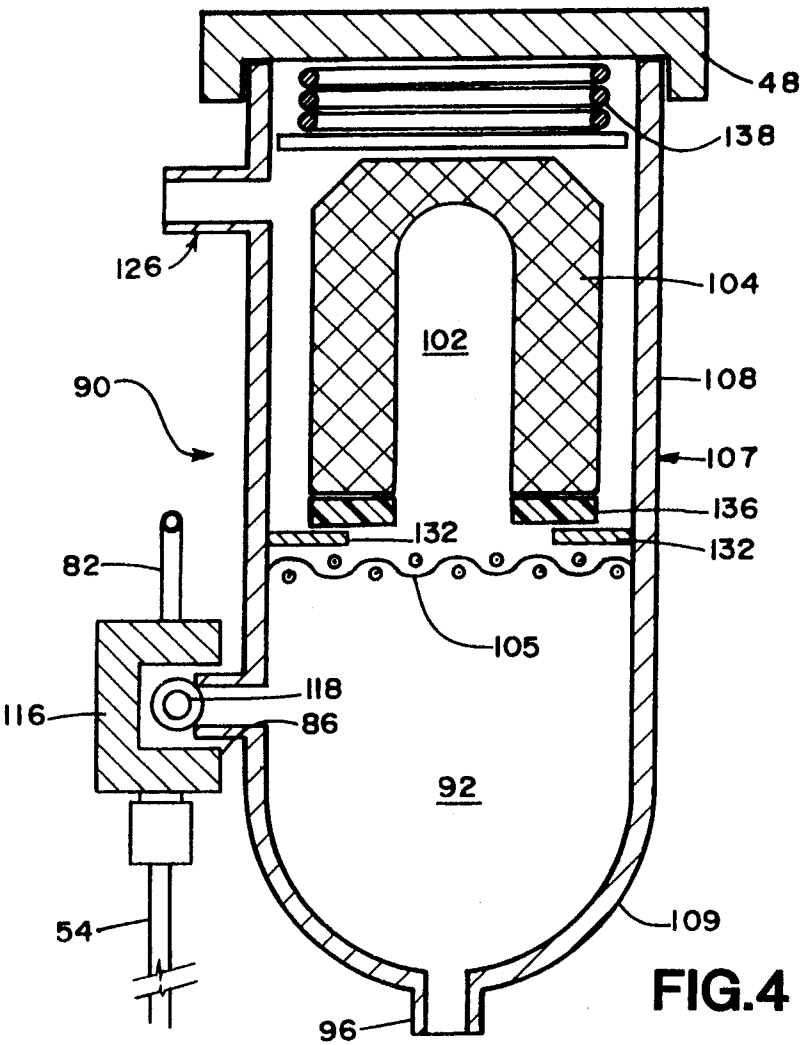
FIG. 4 is a sectional view taken along lines 4—4 of FIG. 3.
Figure 3:
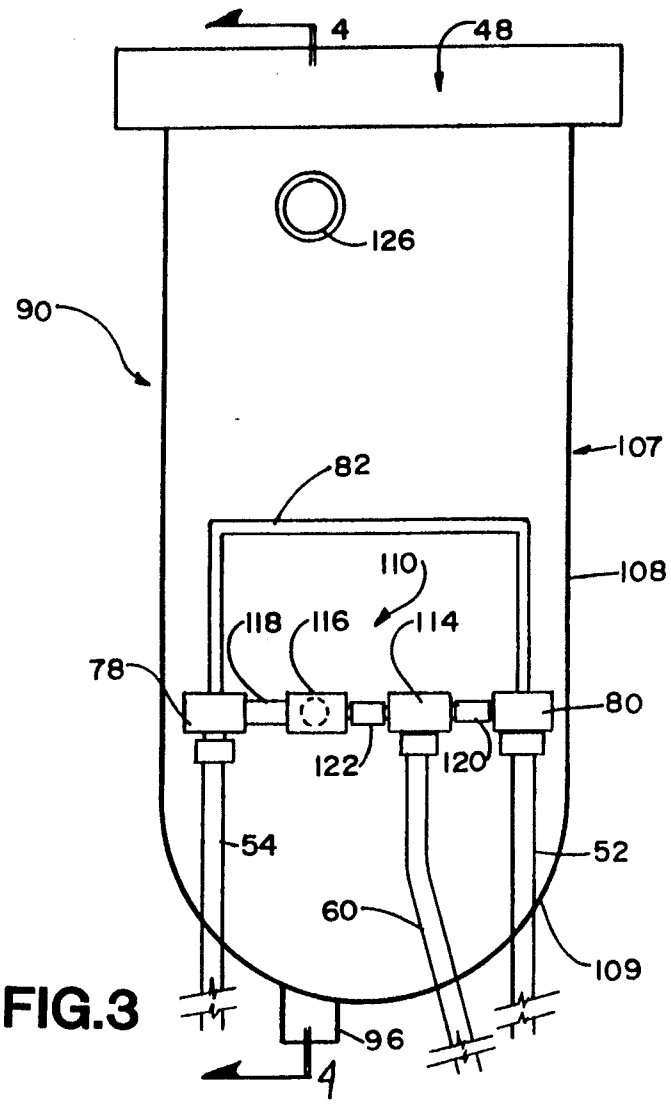
FIG. 3 is a side elevational view of the filter/oil separator of the present invention.

Turning now to FIGS. 2, 3, and 4, the canister 90 for containing the combination filter-dryer/oil separator is shown in more detail.

The canister 90 includes an inlet 86 disposed downstream of both the high side refrigerant hose 54 and the low side refrigerant hose 52. The inlet 86 opens into a first, or lower chamber portion 92 of the canister 90. The lower chamber portion 92 comprises the oil separator portion of the canister 90. Lower portion 92 has generally cylindrical sidewalls, and a hemispherical bottom portion 109. A purge port 96 is disposed at the bottom of the lower chamber 92, through which separated oil O and separated air can be removed. Purge port 96 terminates at its distal end in a purge valve 98. Purge valve 98 is operatively coupled to purge valve button 45 (FIG. 1). The purge valve 98 controls the flow of air and oil through the purge port 96. Purged oil which flows through purge valve 98 is emptied into a receptacle 100 for storage and later disposal.

The canister also includes a second, or upper chamber portion 102. Second chamber portion 102 is provided for containing a filter element 104, and comprises the filter-dryer portion of the canister 90. A screen 105 is disposed between the first chamber portion 92 and the second chamber portion 102 so that all refrigerant passing from the first portion 92 into the second portion 102 must pass through the screen 105. Preferably, screen 105 is a 100 mesh screen that is designed to help trap particulate matter. Additionally, screen 105 provides a surface which fosters the condensation of oil droplets in the refrigerant passing therethrough.

Refrigerant flowing into the lower chamber 92 will tend to evaporate into its vaporous form. Additionally, oil contaminants contained within the refrigerant will tend to precipitate out of the refrigerant, coalesce into droplets, and fall into the bottom of lower chamber 92 adjacent to purge port 96.

As best shown in FIG. 3, the canister 90 comprises a shell 107 having a generally cylindrical sidewall 108 and a generally hemispherical bottom 109. The canister 107 also includes a refrigerant outlet 126 through which filtered refrigerant can flow out of second chamber 102.

A connector 110 is removably coupled to the inlet 86 of the canister 92. The connector 110 contains four fittings, including a first fitting 78, a second fitting 80, a third fitting 114 and a fourth fitting 116. Each of the four fittings 78, 80, 114, 116 includes a T-shaped passageway to permit the flow of fluid therethrough. A first coupler 118 attaches the first fitting 78 to the fourth fitting 116. First coupler 118 includes a blocked passageway, to prevent the flow of fluid between first fitting 78 and fourth fitting 116. This blockage forces refrigerant flowing through fitting 78 to pass through the capillary tube 82 and into second fitting 80. The blockage in connector 118 prevents the refrigerant from bypassing the capillary tube 82.

The second coupler 120 extends between the second fitting 80 and the third fitting 114, to permit fluid to flow therebetween. The second coupler 120 includes an interior passageway, which permits the flow of fluid therein. The third coupler 122 includes a hollow passageway to permit the flow of fluid between third fitting 114 and fourth fitting 116.

Third fitting 114 is coupled to the distal end 60 of the air purge hose 60. Air purge hose 60 extends between the third fitting 114 and the storage tank 20 to permit purged air to be removed from the storage tank 20. Fourth fitting 116 is coupled to inlet 86 of the canister 90, and includes a passageway to permit fluid flowing through fourth fitting 116 to flow into the inlet 86.

As best shown in FIG. 4, the canister 107 includes a generally circular, radially inwardly extending interior flange 132 upon which the filter cartridge 104 rests. A circular flat gasket 136 is placed between the flange 132 and the filter cartridge 104 to sealingly engage the filter 104 to the flange 132. This sealing engagement between the filter 104 and the flange 132 forces refrigerant to flow through the filter 104, and prevents flow around the filter cartridge 104.

Alternately, flat gasket 136 can be formed as a part of the filter cartridge 104 or permanently affixed to the lower end of the filter cartridge 104.

The filter cartridge 104 has the shape of an inverted cup. The purpose of the filter cartridge 104 is to filter out both particulate matter and water from the refrigerant passing therethrough. An example of a filter cartridge 104 which will function in connection with the present invention is the RC 4267 model filter cartridge manufactured by SPORLAN VALVE CO.

An expansion spring 138 is disposed between the cap 48 and the filter cartridge 104 to press downwardly on the filter cartridge 104 to maintain the sealing engagement between the filter cartridge 104, gasket 136 and flange 132. An example of a cap 48 and spring 138 which will function in connection with the present invention is one manufactured by the SPORLAN VALVE COMPANY.

Refrigerant flowing out of the canister 90 flows into the primary flow path 144 of the device 10. A check valve 146 is disposed downstream from the canister 90 outlet 126. The check valve 146 is biased to allow refrigerant to move in the direction indicated by the arrows from the canister 90 toward the compressor 158, but to prevent refrigerant flow in an opposite direction through the primary flow path 144.

A pressure test loop 148 has a first or upstream end 150 disposed downstream from check valve 146, and a second or downstream end 152 disposed upstream from check valve 146. Test loop 148 also includes a normally closed, user operable manual valve 44, and a check valve 154 to permit the flow of fluid in the test loop 148 in only one direction, from first, (upstream) end 150 toward second, (downstream) end 152.

The test loop 148 is used to enable a technician-user to pressurize the refrigeration system to be serviced to test for leaks in the refrigeration system.

When servicing a refrigeration system, it is not unusual that the technician will determine that no refrigerant exists any longer within the refrigeration system 72. Rather, this refrigerant has "leaked out" of the refrigeration system 72. In such case, it is also incumbent upon the technician to determine the source of the leak.

To determine the source of the leak, the technician allows the device 10 to remain in its "system off" condition, and depresses valve 44 to permit refrigerant to flow from the device 10 back into the refrigeration system 72. Typically, the technician will open the valve 44 for only a short period of time to allow only a small amount of refrigerant to flow back into the refrigeration system 72. The technician will then use a "sniffer" such as the K-Whit Tools, Inc. model 03000 sniffer to determine the point in the refrigeration system 72 wherein the leak occurs.

A compressor 158 is disposed downstream of the test loop 148. Examples of compressors that function with the instant invention are the $\frac{1}{4}$ and $\frac{1}{3}$ horsepower compressors manufactured by a variety of compressor manufacturers.

A high pressure sensor and switch arrangement 202 are disposed downstream of the compressor, and upstream of the second oil separator 162. The high pressure sensor senses the pressure downstream from the compressor. If the pressure sensed by high pressure sensor 34 is too high, the high pressure switch 202 will stop operation of the compressor 158 to allow the pressure within the device 10 to become reduced to a lower, and hence safer level. Preferably, the high pressure sensor and switch 202 are set to deactuate the compressor 158 if the high pressure sensor senses a pressure in excess of 435 PSIG. Commercially available high pressure cut-off switches of the type described are available from TEXAS INSTRUMENTS CORPORATION of Dallas, Tex.

A second oil separator 162 is disposed downstream from the compressor 158. An oil return loop 164 has its first, or upstream end 166 disposed at the downstream side of the oil separator 162. The second of downstream end 168 of the oil return loop 164 is disposed upstream from the compressor 158. A solenoid valve 172 which is actuated by a timer 174 is also contained within the oil return loop 164.

As will be appreciated, the operation of the compressor 158 causes oil to be depleted from the compressor 158, and to be added to the refrigerant exiting from the compressor 158. The second oil separator 162, removes this added oil, and returns it via the oil return line 164 to the compressor 158 to replenish the oil lost from the compressor 158. An example of a commercial available "second" oil separator is the Model 304 Oil Separator manufactured by Temprite Co. Inc.

The solenoid valve 172 controls the flow of oil back to the compressor. The opening and closing of the solenoid 172 is controlled largely by timer 174.

When the device 10 is not in operation, or the recovery system within the device 10 is not operating, the solenoid valve 172 is biased to be normally open. By being normally open, oil and refrigerant can flow within the oil return loop 164. By permitting this flow of fluid, the pressure on the upstream side of the compressor 158 becomes balanced with the pressure on the downstream side of the compressor 158 when the system 10 is not operating. This balanced pressure condition on both the upstream and downstream side of the compressor 158 facilitates the start up of the compressor 158 when a new refrigerant recovery cycle commences.

During operation of the system, the timer circuit 174 actuates the solenoid value 172 to close. The closed solenoid does not permit oil to flow from the second oil separator 162 back through to the compressor 158. The timer circuit 174 causes the solenoid valve 172 to open at timed intervals to permit the flow of oil in the return line 164 to replenish the oil lost from compressor 158.

A condenser 178 is disposed downstream of the second oil separator 162. Condenser 178 can be a six foot coiled restrictor tube having a 0.083 inch inner diameter. A fan 180 is disposed adjacent to the condenser 178 to help remove heat from the condenser 178.

The moisture indicator 36 is disposed downstream from the condenser 178. The refrigerant delivery hose 58 is disposed downstream from the moisture indicator 36. Refrigerant delivery hose 58 terminates at its distal end in the blocking valve connector member 59, which is coupled to a valved refrigerant inlet port 64 of the storage tank 20. The refrigerant inlet port has its opening at lower terminus 184. Terminus 184 is disposed adjacent to the bottom of the storage tank 20.

The air purge hose 60 is coupled by a blocking valve connector member 62 to the air purge port 66 of the tank 20. The air purge port 66 is also controlled by a valve. The opening (terminus) 186 of the air purge port 66 is disposed adjacent to the top of the storage tank 20. The terminus 186 disposed adjacent to the top of the interior of tank 20 because air which becomes trapped within the storage tank 20 tends to collect adjacent to the top of the tank. The valve in refrigerant purge port 66 is normally closed.

The storage tank 20 also includes a level sensor 190. The level sensor 190 is provided for sensing the level of refrigerant R within the interior of the storage tank 20. The sensor 190 includes a connector 192 for connecting the sensor 190 to a communications port (not shown), which couples the sensor 190 to the device 10. The level sensor 190 also includes a probe 194 which extends into the interior of the storage tank 20. Examples of liquid level sensors which will perform with the device of the present invention are shown in White and Hancock U.S. patent application Ser. No. 07/725,834, filed Jul. 3, 1991, entitled Liquid Level Sensor for Refrigerant Servicing Device, which is being filed contemporaneously with the instant application.

Figure 5:
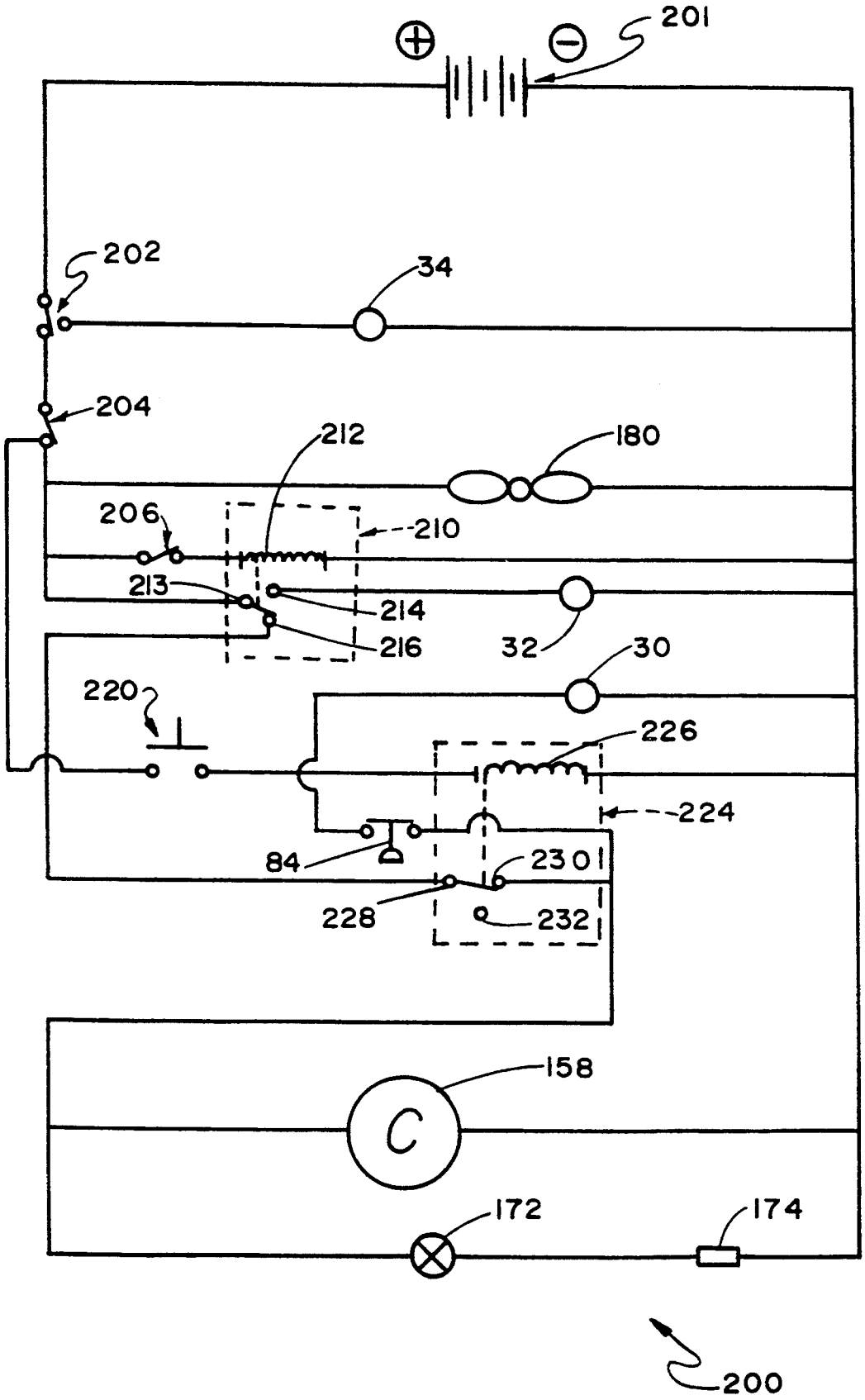
FIG. 5 is a schematic view of the electrical circuitry of the present invention.

The control circuitry 200 for the present invention is best shown in FIG. 5. Circuit 200 includes a power supply 201 which is coupled to a two-position high pressure switch 202. When the pressure measured by the high pressure sensor (not shown) associated with switch 202 is less than the predetermined pressure, the high pressure switch 202 is placed in its position shown in FIG. 1. However, when the pressure at the high pressure sensor (not shown) is greater than the predetermined pressure, the two position high pressure switch 202 moves into its second position to form a connection with high pressure light 34. Main on/off switch 204 is also sequentially coupled to fan 180, so that engagement of the on/off switch 204 will generally start the fan 180.

The main power switch 204 is also connected to a tank full switch 206. Tank full switch 206 is coupled to the tank level sensor 190 (FIG. 2). When the tank level sensor 190 senses that the tank 20 is not full, the coil 212 of relay 210 engages contact between the common terminal 213 and the normally closed terminal 216. However, when the tank sensor 190 indicates that the storage tank 20 is full, the coil 212 of relay 210 moves the contact between the common terminal 213 and the normally open terminal 214. When so positioned, tank full light 232 will be caused to become lighted, and compressor 158 will be deactuated.

Momentary start switch 220 is coupled to relay 224. Relay 224 includes a coil 226, a common terminal 226, a normally opened terminal 214, and a normally closed terminal 232. In relay 224, normally closed contact 232 is coupled to nothing. Normally open contact 230 is coupled to vacuum switch 84.

The momentary start switch 220 works in conjunction with main power on/off switch 204. When main on/off switch 204 is turned to the on position, the compressor 158 will not start operation. The operation of the compressor 158 is started by tripping the momentary start switch 220. The momentary start switch 220 will remain engaged, to provide power to the compressor 158 so long as vacuum switch 84 is closed. Vacuum switch 84 opens when the pressure measured by vacuum switch 84 (FIG. 2) drops below a predetermined rate. Thus, if one tries to use the momentary start switch 220 to actuate the compressor 158, the compressor 158 will be deactuated upon release of the spring loaded momentary start switch 220 if the vacuum switch 84 is in its open position.

Circuit 200 is designed to permit compressor 158 to become engaged only if certain conditions are met. These conditions include the condition that the high pressure switch 202 be in its first position, that the main power switch 204 be turned on, that the momentary power switch 220 be depressed, that the tank full switch 206 not be indicating that the level of refrigerant R within the tank 220 is full, and that the vacuum switch 84 is closed.

The operation of the device 10 will now be described, and can be best understood with reference to FIG. 2.

The device 10 is first properly coupled to the refrigeration system 72 to be serviced and to the storage tank 20. The rocker-type on-off switch 268 is turned to its on position. The momentary start button 42 is then depressed to engage the compressor 158. Circuit 200 will cause compressor 158 to become engaged if the conditions discussed above are met.

Assuming that the required conditions are met, the compressor 158 will begin drawing refrigerant out of the refrigeration system 72. Refrigerant will be drawn both through the high side pressure hose 54 and the low side pressure hose 52. The capillary tube means 82 will conduct refrigerant between the first fitting 78 and the second fitting 80, to facilitate evaporation of the refrigerant being drawn from the high side H of the refrigeration system 72. The refrigerant will then be directed into the lower chamber 92 of the oil separator/filter canister 90. In the lower chamber 92, any liquid refrigerant will usually evaporate into a gaseous state. Oil and water within the refrigerant will tend to become separated from the refrigerant. Any oil drops which coalesce within the chamber 92 interior, or upon screen 105, will generally drop and fall into the lower chamber portion 92. This separated oil can then be purged through the purge port 96, and purge valve 98, and stored ultimately in receptacle 100.

Evaporated refrigerant from which the oil has been separated then flows through screen 105 into the upper chamber 102 of the canister 90. Refrigerant then flows from the upstream surfaces of the filter cartridge 104, through the filter, and then past the downstream surfaces of the cartridge 104, in the directions indicated generally by arrows F. During the passage of the refrigerant through the filter element 104, particulate matter and moisture is removed from the refrigerant. Thus, refrigerant emerging from the refrigerant outlet 126, and passing into the primary flow path 144 should be in a condition wherein it is substantially devoid of particulates and moisture.

Refrigerant then flows through compressor 158, and through second oil separator 162. Oil separated in second oil separator 162 can be returned to compressor 158 by return line 164. Refrigerant passing through the second oil separator 166 then passes through a condenser 178, wherein the refrigerant begins to condense from its vaporous phase into liquid phase. Ultimately, the refrigerant emerging from condenser 178 passes through moisture indicator 36, and is delivered by refrigerant delivery hose 58 into the interior of refrigerant storage tank 20.

As will be appreciated, air often collects near the top spaces of the storage tank 20. To purge the air from the top of the storage tank 20, the air purge valve 45 on the control panel 26 of the device 10 is pressed. Pressing button 45 on the control panel 26 actuates valve 98, to cause waste oil and air within the lower chamber 92 of the canister 90 to be removed therefrom. Air purge line 60 is provided for transporting the air between the refrigerant storage tank 20 and the inlet 86 of the lower chamber 92 of the canister 90.

When the compressor 158 is actuated so that it is operating, solenoid valve 172 is closed. The solenoid valve 172 will open only in response to timer 174. Timer 174 opens solenoid valve 172 on a timed basis.

When the device 10 is turned off, the solenoid valve 172 is placed in its opened position to allow refrigerant to pass through the solenoid valve, thereby equalizing the pressure between the upstream and downstream sides of the compressor 158. Due to the presence of check valve 146 and normally closed pressure test valve 44, the opening of solenoid valve 172 will not permit any refrigerant to flow into the interior of canister 90.

Having described the invention in detail, and by reference to the preferred embodiments thereof, it will be apparent that modifications and variations are possible without departing from the scope of the invention as defined in the appended claims.

What is claimed is:

1. A combination oil separator and filter device for a refrigerant recovery apparatus, the device comprising (a) a canister means having a first chamber portion for separating oil from refrigerant, and a second chamber portion for filtering the refrigerant, (b) an inlet means through which refrigerant can be introduced into the first chamber portion, (c) an oil outlet means for conducting oil from the first chamber portion, (d) a filter cartridge placeable in the second chamber portion, (e) a refrigerant outlet means through which refrigerant can be withdrawn from the second chamber portion, (f) a refrigerant hose connector means for connecting a downstream end of a low side refrigerant hose and a downstream end of a high side refrigerant hose to the inlet means, and (g) an extended capillary tube means extending between the downstream end of the high side refrigerant hose and the inlet means.

2. The invention of claim 1 further comprising a screen means disposed in the path of refrigerant flow between the first chamber portion and the second chamber portion.

3. The invention of claim 2 wherein the screen means comprises about a 100 mesh screen.

4. The invention of claim 1 wherein the filter cartridge includes an upstream surface, a downstream surface and a seal means disposed on a surface of the filter cartridge between the upstream surface and the downstream surface to force the refrigerant to flow through the filter cartridge.

5. The invention of claim 1 further comprising a user actuable purge means for permitting the user to remove collected oil and air from the first chamber portion.

6. The invention of claim 1 wherein the canister means includes a removable cap means for permitting ingress to the second chamber portion to permit removal and replacement of the filter cartridge.

7. The invention of claim 1 wherein the connector means includes a first fitting member to which the downstream end of the high side refrigerant hose is coupled, a second fitting member to which the low side refrigerant hose is coupled, and wherein the capillary tube mean extends between the first fitting means and the second fitting means.

8. The invention of claim 7 further comprising a third fitting member coupled to the inlet means, and blockage means for preventing the flow of refrigerant between the first fitting member and third fitting member except through the capillary tube means.

9. A single pass refrigerant recovery device for withdrawing refrigerant from a refrigeration system to be serviced, processing the refrigerant so withdrawn, and depositing the refrigerant so processed into a storage means, the recovery device comprising a compressor, an oil separator disposed downstream from the compressor, an oil return line means having a first end disposed downstream from the oil separator means and a second end disposed upstream from the compressor means, a valve means for controlling the flow of material in the oil return line means, and means for controlling the opening and closing of the valve means for permitting the controlled flow of materials in the oil return line means between the oil separator means and the compressor means during operation of the device to ensure an adequate replenishment of a supply of oil in the compressor, and for biasing the valve in an open position when the device is not operating to permit refrigerant to flow therethrough to substantially balance the pressure upstream from the compressor with the pressure downstream from the compressor.

10. The invention of claim 9 wherein the valve means comprises a solenoid valve means.

11. The invention of claim 9 wherein the solenoid valve means is closed normally during the operation of the device, opening only at predetermined intervals to permit oil to flow through the oil return line means to allow replenishment of the oil in the compressor means.

12. The invention of claim 9 wherein the oil separator comprises a second oil separator, further comprising a first oil separator disposed upstream from the compressor for separating oil from recovered refrigerant.

13. The invention of claim 12 further comprising a filter means disposed downstream from the first oil separator, a condenser means disposed downstream from the second oil separator, and a storage tank disposed downstream from the condenser means.

14. A single pass refrigerant recovery device for recovering refrigerant from a refrigeration system comprising (a) at least one refrigerant hose for withdrawing refrigerant from the refrigeration system, (b) a first oil separator means for separating oil from recovered refrigerant, the first oil separator means being disposed downstream from the at least one refrigerant hose, (c) a filter means disposed downstream from the oil separator means, the first oil separator means and the filter means being housed within a unitary canister means, (d) a compressor means disposed downstream from the filter means, (e) a second oil separator means disposed downstream from the compressor means, (f) a condenser means disposed downstream from the second oil separator means, (g) a moisture indicator means disposed downstream from the condenser means, (h) a storage tank means disposed downstream from the moisture indicator means, (i) an oil return line means having a first end disposed downstream of the second oil separator means and a second end disposed upstream of the compressor means, (j) a valve means for controlling the flow of material in the oil return line means, and (k) means for controlling the opening and closing of the valve means for permitting the controlled flow of materials in the oil return line means between the oil separator means and the compressor means during operation of the device to ensure an adequate replenishment of a supply of oil in the compressor, and for biasing the valve in an open position when the device is not operating to permit refrigerant to flow therethrough to substantially balance the pressure upstream from the compressor with the pressure downstream from the compressor.

15. The invention of claim 14 wherein the valve means comprises a solenoid valve means, and the means for controlling the opening and closing of the valve means comprises a timer means.

16. The invention of claim 15 wherein the timer means causes the opening of the solenoid valve means at predetermined intervals to permit materials to flow in the oil return line means between the second oil separator means and the compressor means.

* * * * *

US005335512C1

(12) EX PARTE REEXAMINATION CERTIFICATE (9468th)

United States Patent
Hancock et al.

(10) Number: US 5,335,512 C1
(45) Certificate Issued: Jan. 7, 2013

(54) REFRIGERANT RECOVERY DEVICE

(75) Inventors: John P. Hancock, Indianapolis, IN (US); Ralph A. McClelland, Indianapolis, IN (US)

(73) Assignee: SPX Corporation, Charlotte, NC (US)

Reexamination Request:
No. 90/009,867, Feb. 17, 2011

Reexamination Certificate for:

| | |
|---|---|
| Patent No.: | **5,335,512** |
| Issued: | **Aug. 9, 1994** |
| Appl. No.: | **07/987,352** |
| Filed: | **Dec. 7, 1992** |

Related U.S. Application Data

(63) Continuation of application No. 07/676,740, filed on Mar. 28, 1991, now Pat. No. 5,168,721.

(51) Int. Cl.
*F25B 45/00* (2006.01)

(52) U.S. Cl. ..... 62/292; 62/77

(58) Field of Classification Search ..... None
See application file for complete search history.

(56) References Cited

To view the complete listing of prior art documents cited during the proceeding for Reexamination Control Number 90/009,867, please refer to the USPTO's public Patent Application Information Retrieval (PAIR) system under the Display References tab.

*Primary Examiner* — Jeffrey L. Gellner

(57) ABSTRACT

A single pass refrigerant recovery device recovers refrigerant from a refrigeration system. The device includes at least one hose for withdrawing refrigerant from the refrigeration system and a first oil separator disposed downstream of the refrigerant hose. A filter is disposed downstream from the oil separator and a compressor is disposed downstream from the filter. A second oil separator is disposed downstream from the compressor, and the condenser is disposed downstream from the second oil separator. A moisture indicator is disposed downstream from the condenser, and a storage tank is disposed downstream from the moisture indicator. The refrigerant recovery device also contains an oil return line having a first end disposed downstream from the second oil separator, and a second end disposed upstream from the compressor. A solenoid valve in the oil return line controls the flow of material in the oil return line. A timer for controls the opening and closing of the valve means for permitting the controlled flow of materials in the oil return line between the oil separator and the compressor during operation of the device to ensure an adequate replenishment of a supply of oil in the compressor, and for biasing the valve in an open position when the device is not operating to permit refrigerant to flow therethrough to substantially balance the pressure upstream from the compressor with the pressure downstream from the compressor.

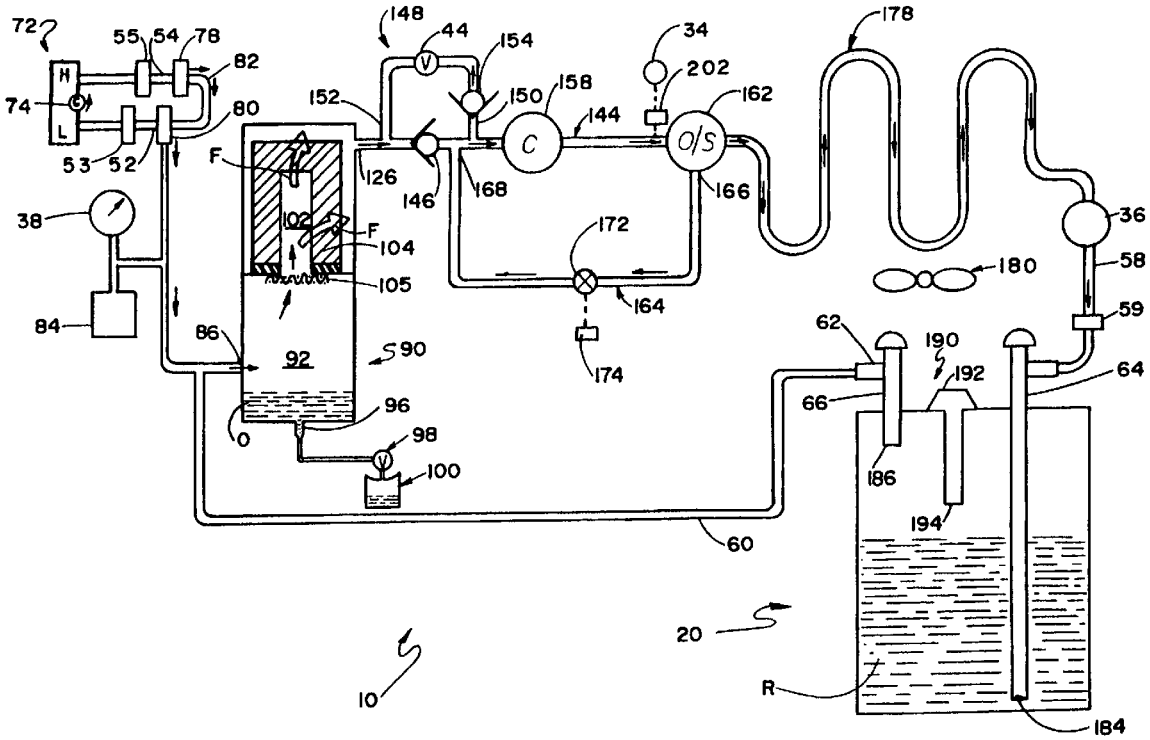

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 9-13 are cancelled.

Claims 1-8 and 14-16 were not reexamined.

* * * * *